United States Patent [19]

Crites et al.

[11] Patent Number: 4,484,427

[45] Date of Patent: Nov. 27, 1984

[54] METHOD AND APPARATUS FOR ATTACHING FURRING TO COLUMNS

[75] Inventors: Robert C. Crites, P.O. Box 513, Euless, Tex. 76039; Wilbur R. Youngs, Allen, Tex.

[73] Assignee: Robert C. Crites, Euless, Tex. ; a part interest

[21] Appl. No.: 370,175

[22] Filed: Apr. 20, 1982

Related U.S. Application Data

[63] Continuation-in-part of Ser. No. 355,703, Mar. 8, 1982.

[51] Int. Cl.[3] ..... E04C 3/30; E04B 1/94

[52] U.S. Cl. ..... 52/261; 52/727; 52/712

[58] Field of Search ..... 52/727, DIG. 8, 712, 52/715, 261

[56] References Cited

U.S. PATENT DOCUMENTS

| | | | |
|---|---|---|---|
| 1,675,226 | 6/1928 | Munroe et al. | 52/363 |
| 2,089,941 | 8/1937 | Burson | 52/376 |
| 2,724,960 | 11/1955 | Nelsson | 52/712 |
| 2,924,090 | 2/1960 | Schneller | 52/712 |
| 3,333,379 | 8/1967 | Harris | 52/364 |
| 3,362,120 | 1/1968 | Warren | 52/309.2 |
| 3,413,775 | 12/1968 | Katz | 52/727 |
| 3,570,376 | 3/1971 | Overton et al. | 52/727 |
| 3,748,815 | 7/1973 | Parker | 52/727 |
| 3,897,669 | 8/1975 | Uydess | 52/713 |
| 3,998,028 | 12/1976 | Pelletier | 52/727 |

FOREIGN PATENT DOCUMENTS

| | | | |
|---|---|---|---|
| 2917551 | 11/1979 | Fed. Rep. of Germany | 52/727 |
| 1186867 | 4/1970 | United Kingdom | 52/727 |
| 0773218 | 10/1980 | U.S.S.R. | 52/727 |

*Primary Examiner*—John E. Murtagh
*Assistant Examiner*—Kathryn Ford
*Attorney, Agent, or Firm*—Richards, Harris & Medlock

[57] ABSTRACT

A system for attaching furring adjacent a column includes a corner clip (140, 142) having a first leg (160) for attachment adjacent a column and a second leg (162) extending from the first leg. The second leg (162) extends substantially longitudinally of the column. The clip may be attached directly to the column or to the ceiling or decking adjacent the column. One end of a corner angle (150) is engaged over the second leg of the clip. The opposite end of the corner angle is engaged over the corresponding leg of a similar clip. The corner angle is then plumbed by moving the second end of the angle and clip, and the clip is attached to the decking or ceiling to maintain the angle plumb. Furring (G) is attached to the corner angle to cover the column.

14 Claims, 19 Drawing Figures

METHOD AND APPARATUS FOR ATTACHING FURRING TO COLUMNS

CROSS REFERENCE TO RELATED APPLICATION

This application is a continuation-in-part of U.S. patent application Ser. No. 355,703, filed Mar. 8, 1982, by the present applicants and entitled "Method and Apparatus for Attaching Furring to Columns."

TECHNICAL FIELD

The present invention relates to a method and apparatus for attaching furring to or adjacent to columns and similar structures. The invention uses a unique clip which makes the process faster and less expensive while providing improved support for the furring.

BACKGROUND ART

In many instances, it is desirable to cover structural columns used in building construction. Covering of columns may be for one of several reasons, including protection of the columns in the event of fire or merely to provide a decorative surface over the column. Where the covering serves as a heat shield, it may take the place of more expensive fire proofing such as manual plastering or applying a similar coating directly to the column.

Although several prior methods and structures have been used to attach gypsum board and other similar materials to columns, these prior systems have required the use of considerable materials and time. One of the most common methods of attachment uses a hat section rail which is attached at the edges of each of the sides of the column along the longitudinal length thereof. These hat section rail strips are fastened to the column by nails which are driven by an explosive charge or "shot" through the hat section rails and into the column. This technique requires two hat section rails at each corner which run the full length of the column. As many as sixty shots are required to fasten the rails to the column. Additionally, because of the design of the hat section rails, no support is provided by the hat section rails immediately behind the gypsum board at the very corner defined by the covering.

The resilient furring channel shown in U.S. Pat. No. 3,333,379 to D. A. Harris, issued Aug. 1, 1967, illustrates one type of hat section rail which has been used. The more common hat section rail found in use is a solid rail not having the openings in the upstanding leg as shown in the furring channel disclosed in the Harris patent.

Other devices have been used for attaching furring to various structural components. For example, the patent to Uydess, U.S. Pat. No. 3,897,669, issued Aug. 5, 1975, discloses a clip for securing plasterboard to I-beam girders. This device would not be usable in attaching gypsum board, or the like, to solid concrete columns.

DISCLOSURE OF THE INVENTION

The present invention provides a method and apparatus for attaching gypsum board, wallboard and the like to structural columns which are less expensive, both in cost of components and labor required, than the prior art. The invention may be used on concrete or steel columns, as well as columns of other configurations. The present invention provides support immediately behind the gypsum board or other covering at the very corner of these coverings, thus providing a more sturdy and stable finished structure. The present invention also provides a method and apparatus which eliminate the need for two rails at each corner and provide for a more expedititious manner of attaching covering structure to the column.

In accordance with one embodiment of the invention, the structure for attaching furring to a column includes a corner clip with a first portion having a pair of spaced notches therein and a second portion extending from the first portion at an angle thereto. A band encircles the column and engages the second portion of the clip to attach it to the column. The clips are attached at spaced distances along the column. A corner angle is engaged into the notches in the corner clip using at least two of the clips spaced along the column. Gypsum board, particle board or the like is then attached to the corner angles with appropriate fasteners.

In a more specific embodiment of the invention, the first portion of the corner clip has a pair of legs in an L-shaped configuration with the second portion of the clip including a leg extending from each leg of the first portion. The legs of the second portion of the clip are at right angles to the first portion and lie in planes substantially perpendicular to each other. The corner angle comprises an angle having inturned end tips for snap engagement into the slots of the corner clip. The slots in the corner clip are aligned substantially at right angles to each other.

In an alternative embodiment, the present invention may also be practiced using a clip having a substantially rectangular first portion with a notch therein and a second portion extending at an angle from the first portion for engagement to the column. Two of the fittings are attached, such as by banding, to the column at spaced points along the column and adjacent to one corner. A corner angle is attached to the clips by engaging one inturned end tip of the angle into the notch in the spaced corner clips with the other inturned end tip of the angle being engaged between the second portion of the corner clip and the column.

At times, a column or other structure to which furring is to be attached is out of plumb. In this event, attaching the furring directly to the column both at the upper and lower ends will reflect the out of plumb orientation of the column. The present invention provides an alternative structure for attaching furring adjacent to a column or similar structure which permits plumbing the furring attached around the structure. This embodiment incorporates a clip having one leg for attachment adjacent to the structure and a second leg extending from the first leg with a portion thereof substantially longitudinal of the structure. This clip may be attached directly to the column or structure or to the ceiling or decking adjacent the column.

One end of a corner angle is engaged over the second leg of the clip. The opposite end of the corner angle is engaged over the second leg of a similar clip. The corner angle is then plumbed by moving the second end of the angle and clip. The clip is attached to the decking or ceiling to maintain the angle plumb.

In furring a column, the clips are attached adjacent to the corners of the column at spaced distances along the longitudinal length thereof. Similarly, clips are attached either to or adjacent to the column at the other corners of the column and corner angles are engaged therebetween. With each of the corner angles in place and plumbed adjacent to the corners of the column, furring is then attached to the corner angles to complete the closure of the column.

The corner angle has inturned end tips for engagement around the second leg of the corner clip. The second leg of the clip is oriented at an appropriate angle to position one leg of the corner angle parallel to one face of the column. The other face of the corner angle is aligned substantially parallel to the adjacent face of the column.

In one embodiment of the invention, the second leg of the corner clip includes a flat member oriented at a 45° angle from adjacent sides of a rectangular column on which the clip is used. In an alternative embodiment, the second leg of the clip includes two upstanding legs at right angles one to the other with one of the legs having its surface substantially parallel to one surface of the column and the second leg having its surface substantially parallel to the adjacent side of the column. Again, in this alternative embodiment, the ends of the corner angles are engaged over the two portions of the second leg of the corner clip. Furring is then attached to these corner angles to cover the column.

BRIEF DESCRIPTION OF THE DRAWINGS

For a more complete understanding of the present invention, and for further details and advantages thereof, reference is now made to the following Detailed Description taken in conjunction with the accompanying Drawings, in which.

DETAILED DESCRIPTION

Figure 1:
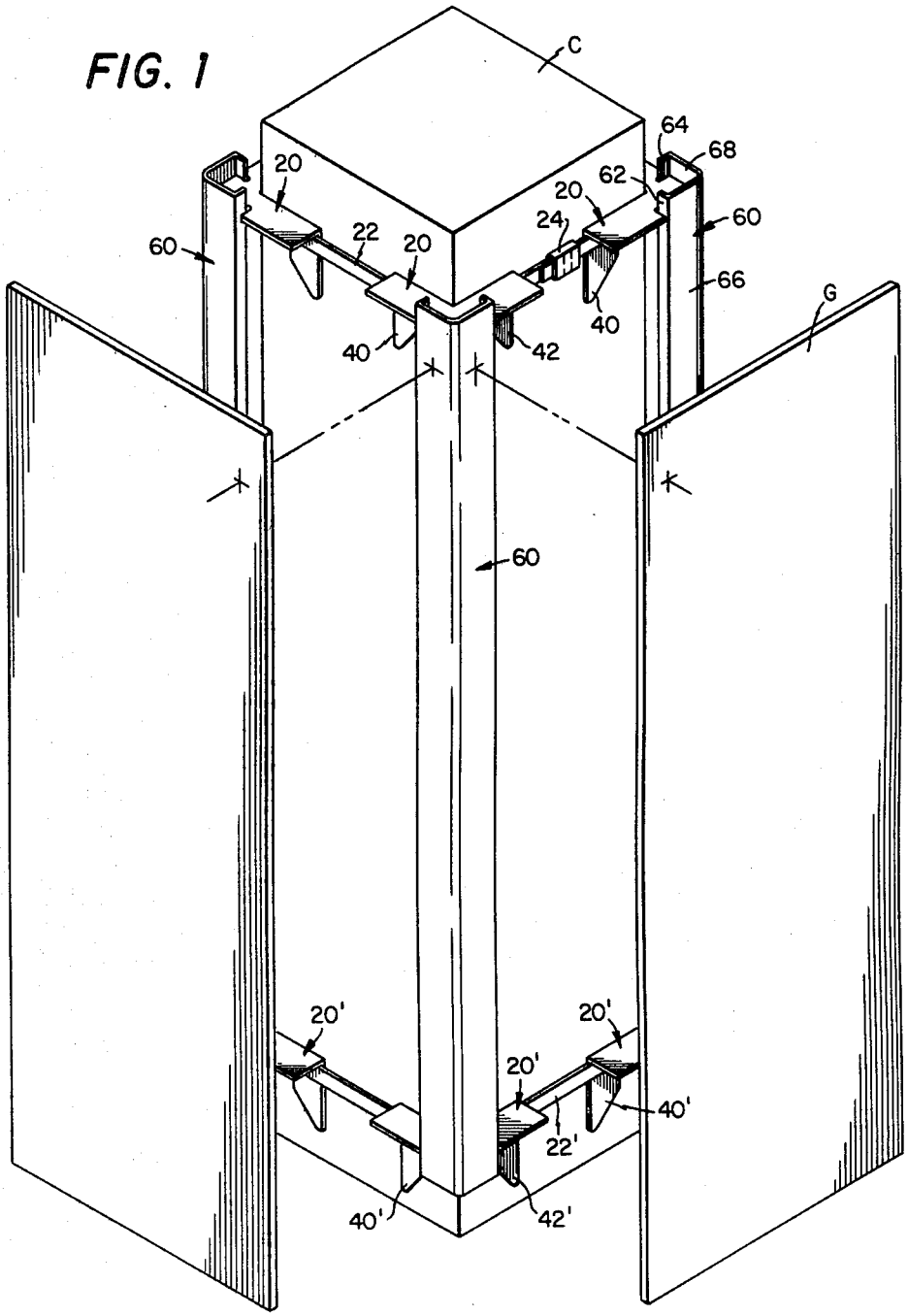
FIG. 1 is a perspective view showing the present invention for attaching a furring to a column with the furring exploded away from the attachment structure for clarity.

Referring to FIG. 1, the structure of the present invention for attaching furring to a column includes four identical corner clips 20 attached to the column C by a band 22 encircling the column for engaging a portion of clip 20 to the column. Band 22 is joined at its ends by an appropriate crimp fitting 24.

Figure 2:
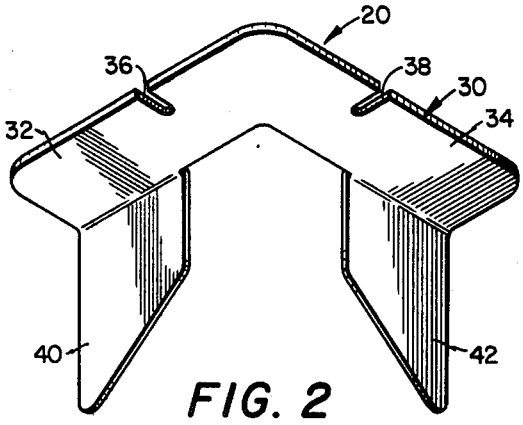
FIG. 2 is a perspective view showing the corner clip used in the present invention.

As is best seen in FIGS. 1 and 2, corner clip 20 includes a planar L-shaped upper portion 30 consisting of legs 32 and 34. A notch 36 is formed in leg 32 and a similar notch 38 is formed in leg 34. Legs 32 and 34 are at right angles to one another as are notches 36 and 38. The leg portion of clip 20 includes a downwardly extending leg 40 formed at a right angle to leg 32 and a similar downwardly extending leg 42 formed at a right angle to leg 34.

It will be appreciated that clip 20 may easily and inexpensively be made from a single piece of flat stock having equal side dimensions. Manufacture can be accomplished by rounding the corners of the square section of material, cutting notches 36 and 38 and removing a square blank from the center of the section. A diagonal cut is then made from the corner opposite the corner between notches 36 and 38 to the blank and legs 40 and 42 are bent at right angles to legs 32 and 34, respectively. It will be understood that clip 20 may be made in any number of ways, including die casting. Of course, several methods of structure are contemplated, each of which is considered to come within the scope of the present invention.

Referring specifically to FIG. 1, a second attachment structure, identical to that shown near the upper portion of column C, is attached at a point along the column structure spaced from the first attachment structure. Thus, corner clips 20' are attached to column C using a band 22' to engage downwardly extending legs 40' and 42' to the column.

Figure 3:
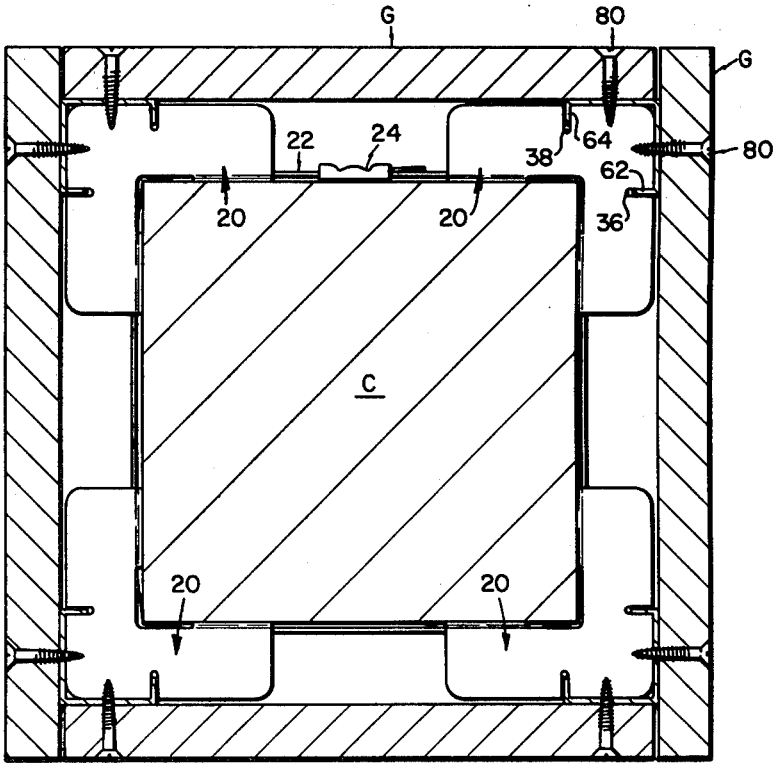
FIG. 3 is a section view as it would appear taken on FIG. 1 with the furring attached to the column.

A corner angle 60 is attached adjacent the corner of column C by engagement of inturned end tips 62 and 64 into notches 36 and 38, respectively. This engagement is also shown in the section view illustrated in FIG. 3. Corner angle 60 includes legs 66 and 68 from which inturned end tips 62 and 64 extend, respectively. The outwardly extending surfaces of legs 66 and 68 are knurled as is shown in FIG. 1 to facilitate driving of screws therethrough as will be discussed hereinafter in greater detail.

Figure 4:
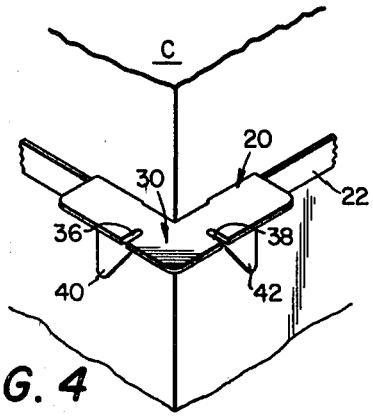
FIGS. 4, 5 and 6 illustrate the steps of construction for the present invention.
Figure 5:
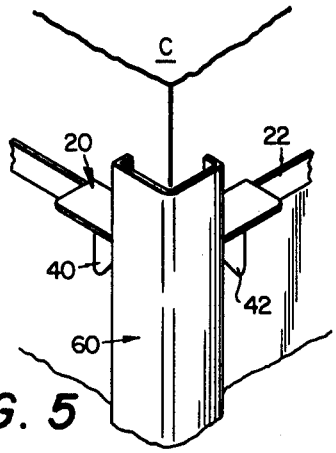
Figure 6:
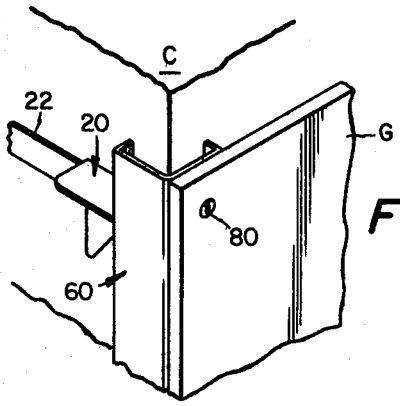

The method of use of the present invention is illustrated in the sequence of FIGS. 4–6. FIG. 4 shows clip 20 being attached to column C by band 22. This step is quickly and easily achieved by placing one of the clips 20 at each corner of the column, encircling the column with band 22 with downwardly extending legs 40 and 42 of clip 20 engaged between band 22 and column C. Tension is drawn on band 22 and the band is tied off by using a standard crimp fitting as is well known in the art. With clip 20 attached to the column, as is shown in FIG. 4, notches 36 and 38 are positioned away from the column as shown. Corner angle 60 is then easily snapped into place with inturned end tips 62 and 64 engaging notches 36 and 38 of corner clip 20. It will be understood that corner angle 60 is sufficiently flexible such that one inturned end tip may be engaged into its corresponding notch with the other end tip being snapped into its respective notch by merely applying a slight force to the corner angle. Once in its snapped position, the angle is securely in place positioned at an appropriate distance from column C over its entire length. As is shown in FIG. 6, gypsum board, wallboard or other covering is then attached directly to corner angle 60 by the use of appropriate screws 80. Knurling the faces of corner angle 60 facilitates the engagement of screws 80 through gypsum board G into the angle.

Any number of screws may be used along the length of the gypsum board with any desired spacing. As can readily be seen in FIG. 3, the present invention provides a support structure, namely, corner angle 60, at the immediate corner of the column. Unlike the prior art hat rail sections, no support at the immediate corner beneath the gypsum board is provided. As can also be appreciated by viewing FIG. 3, once all four sides are attached to the column, the structure is integrally attached such that even the release of band 22 will not effect the attachment of the furring to the column.

Although the invention as illustrated and described with respect to FIGS. 1–6 has taught the attachment of clip 20 to column C using a band, it will, of course, be appreciated by those skilled in the art that other means of attachment of clip 20 to column C may be used. For example, clip 20 may be attached using fasteners, adhesive or other alternative methods. All of these methods are contemplated and are intended to be within the scope of the present invention.

Figure 7:
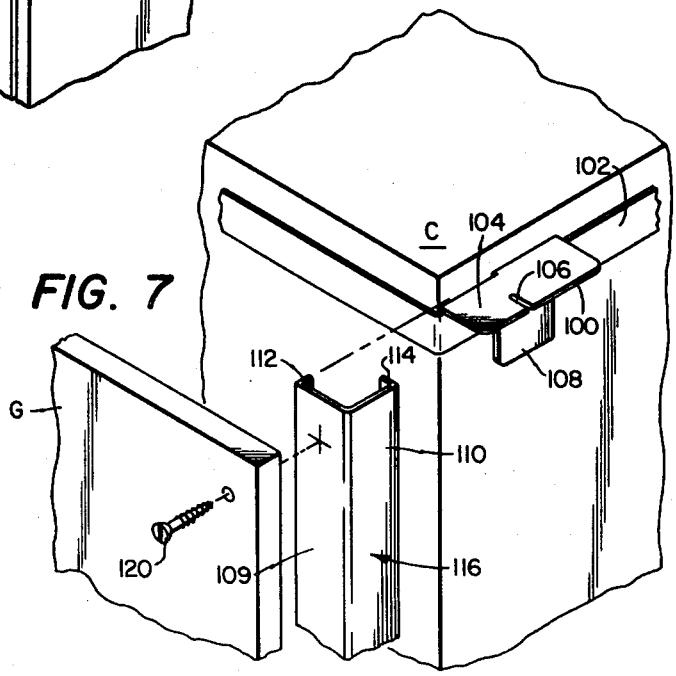
FIG. 7 shows an alternative form of the present invention.

FIG. 7 illustrates an alternative embodiment of the present invention which permits the gypsum board or other covering to be placed adjacent to at least one surface of the column upon assembly. In this arrangement, a clip 100 is attached to column C using a band 102. Clip 100 includes an upper portion 104 having a notch 106 therein. A leg 108 extends downwardly and at right angles from upper portion 104. Lower leg 108 is secured to column C by band 102. In this way, upper portion 104 of clip 100 extends at right angles from the side wall of column C as shown. A corner angle 116 includes legs 109 and 110 with inturned end tips 112 and 114, respectively, extending therefrom.

As in the primary embodiment illustrated in FIG. 1, a clip similar to that shown in FIG. 7 is also attached to the column at a spaced point adjacent the corner of the column. Corner angle 116 is then engaged onto clip 100. This is accomplished by sliding inturned end tip 112 between band 102 and upper portion 104 of clip 100 and snapping inturned end tip 114 into notch 106. Then, an appropriate gypsum board G is attached to corner angle 116 by appropriate fasteners 120. As will be appreciated, attachment can be made using any number of fasteners 120 at any position along the length of corner angle 116. The other faces of the column may then be covered using similar covering boards which are secured in the same way to corner angle 116.

Thus, the present invention provides a means for attaching furring to a column which saves time and expense, both in the cost of the attachment structure and the cost of labor. The system of the present invention incorporates structure which provides a corner angle, positioned at an appropriate distance from the column at each corner of the column. In this way, gypsum board or similar covering material may be attached to the corner angle by using standard fasteners to complete the furring of the column. Once assembled, the furring is locked in place to provide a very secure covering.

While the present invention has been described as it might be used to cover a column, it will be appreciated that the present invention might also be used to cover any outside corner surface. In such an arrangement, the corner clips would be attached to the corner by any suitable means, such as fasteners or adhesives. To these corner clips, the corner angles would be attached and the covering fastened thereto. Thus, the present invention is not to be limited to its mere application to the covering of columns.

In some construction, a support column or other structure to which furring is to be attached is or may be out of plumb. In this case, attaching the furring directly to the structure both at the upper and lower ends will result in the furring being out of plumb. The corner clips shown in FIGS. 8–15 provide an alternative structure for attaching furring adjacent to a column or other structure which permits plumbing the furring.

Figure 8:
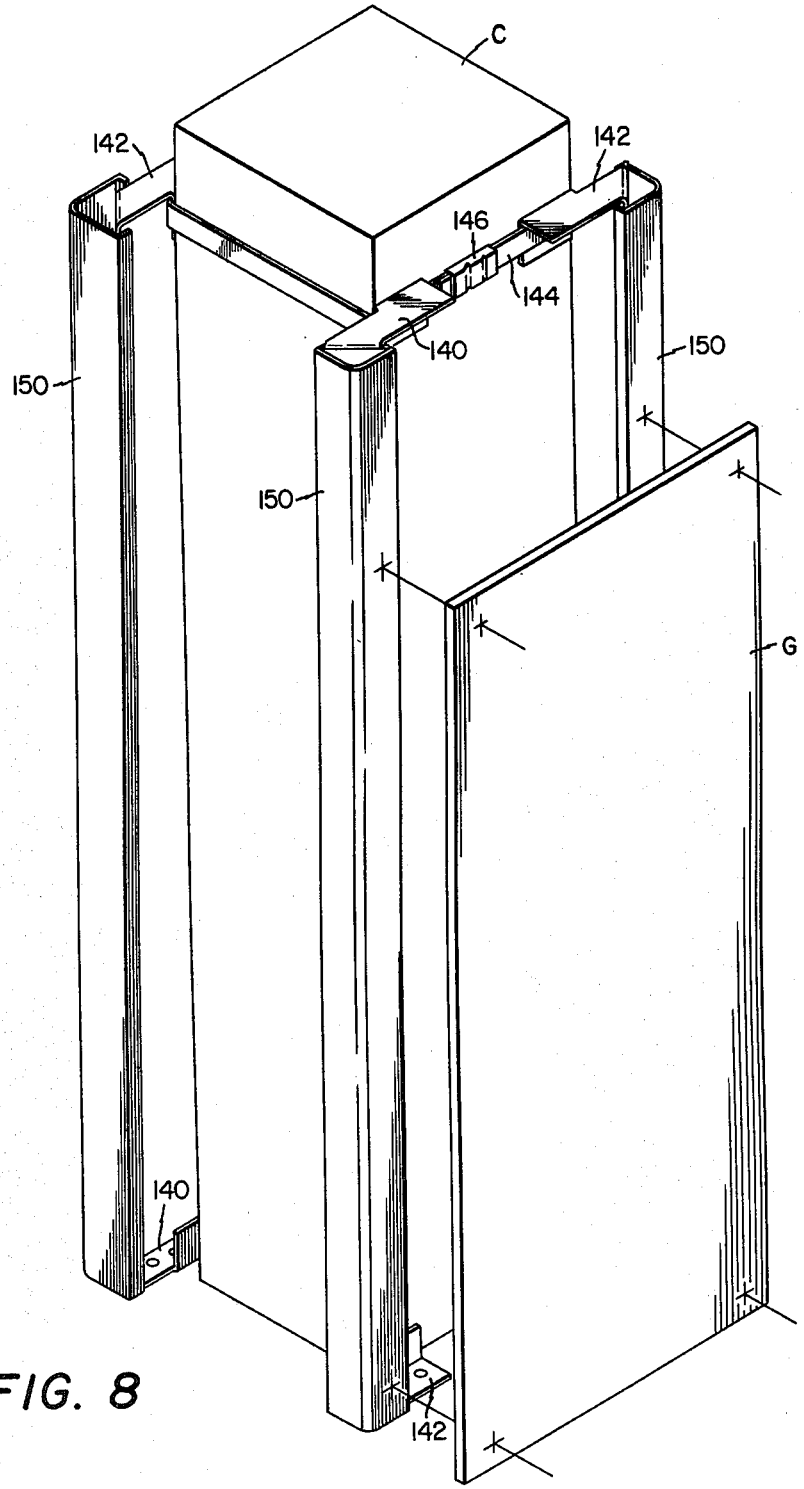
FIG. 8 is a perspective view showing an alternative embodiment of the present invention for attaching a furring to a column with the furring exploded away from the attachment structure for clarity.
Figure 10:
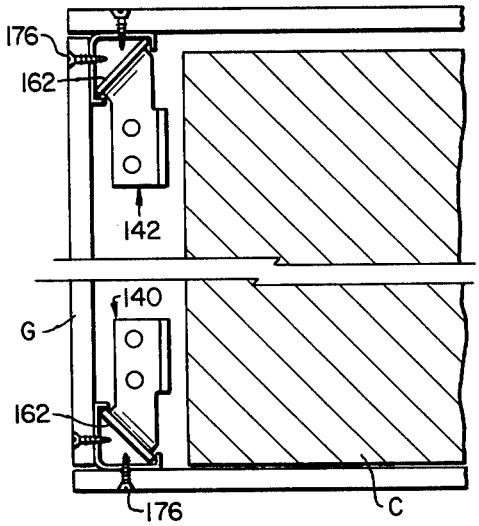
FIG. 10 is a section view as it would appear taken on FIG. 8 with furring adjacent each side of the column.
Figure 12:
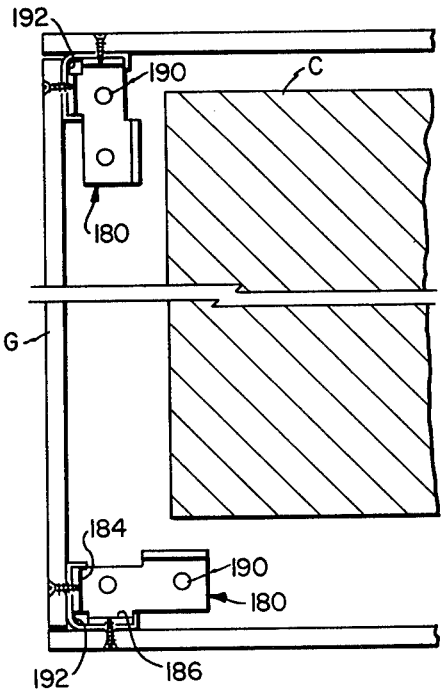
FIG. 12 is a section view as it would appear taken of a column in which the clip shown in FIG. 11 is used to attach furring adjacent to the column.

Referring to FIG. 8, this alternative structure includes clips 140 and 142 attached at the upper end of column C by a band 144. Band 144 is joined at its ends by an appropriate crimp fitting 146. Corner angles 150 are attached between upper clips 140 and 142 and lower clips 140 and 142, as shown in FIGS. 10 and 12. To permit plumbing of angles 150, lower clips 140 are attached to decking D rather than being attached to column C.

Figure 9:
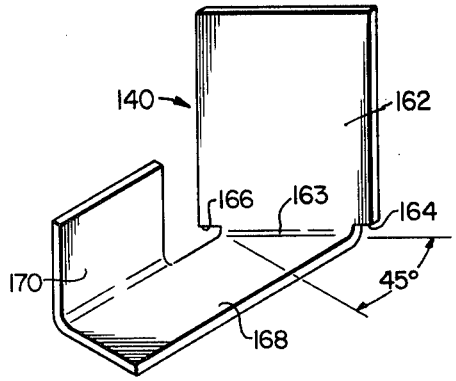
FIG. 9 is a perspective view showing the corner clip used in the invention illustrated in FIG. 8.

As is best seen in FIGS. 8 and 9, corner clip 140 includes a base leg 160 with an upturned leg 162. Leg 162 is formed, as by bending, at a right angle to base leg 160. The bend line 163 is at a 45° angle to the longitudinal axis of base leg 160. In the clip shown in FIG. 9, upright leg 162 is slightly wider than bend line 163 to provide a slight extension 164 and 166 beyond the width of base leg 160. It will of course be appreciated, that the present invention may be practiced without designing upright leg 162 with extensions 164 and 166.

A column attachment flange 170 extends upwardly at a right angle from base leg 160. Whereas clip 140 may be described as a right hand part, clip 142 is a left hand counterpart.

Referring to FIGS. 8 and 10, it can be seen that clip 140 may be attached to or adjacent the column either by banding using flange 170 or by attachment to the ceiling or decking by using a shot fastener or the like through base leg 160. In one use of clips 140 and 142, the clips are banded to the upper portion of the column and the upper ends of corner angles 150 engaged around upstanding leg 162. Clips 140 and 142 are positioned in the lower ends of corner angles 150 and the angles are plumbed by moving the lower ends to a required position relative to the column. It will be appreciated that clips 140 and 142 may be moved longitudinally relative to the end of corner angles 150 until base leg 160 engages decking D. By attaching base leg 160 to decking D, the corner angles 150 are then fixed relative to the column. Gypsum board or other similar furring G is then attached to corner angles 150 using suitable fasteners as discussed hereinbefore.

It will of course be understood that clips 140 and 142 may be attached to the decking as shown in FIG. 8 and also to the ceiling at the upper end of column C rather than being banded to the column as shown. In this way, columns which are substantially out of plumb will not affect the plumbing of the corner angles 150 and the gypsum board attached thereto. Alternatively, clips 140 and 142 may be attached to the column at both the upper and lower ends using a band for engagement around flange 170.

FIG. 10 shows the lower clips 140 and 142 attached to decking D with corner angles 150 engaged around upstanding leg 162 and with gypsum board G attached to the angles using suitable fasteners 176.

Figure 11:
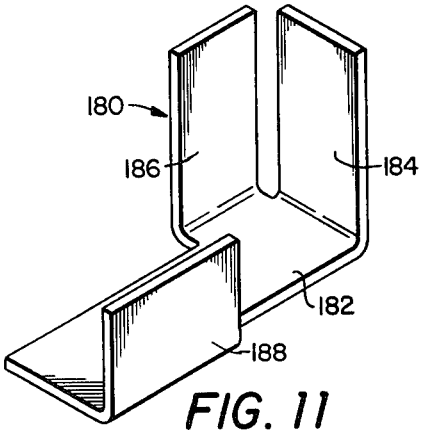
FIG. 11 is a perspective view of another corner clip used in an alternative embodiment of the present invention.
Figure 13:
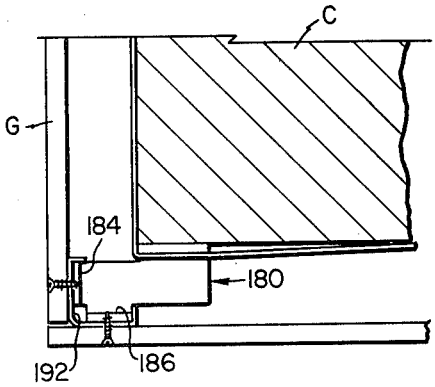
FIG. 13 is a section view as it would appear taken through a column on which the clip shown in FIG. 11 is used to attach furring directly to the column.

FIGS. 11–13 illustrate an alternative clip 180 for use in attaching furring adjacent a column. Clip 180 includes a base leg 182 with two upturned angling engaging legs 184 and 186. Legs 184 and 186 are formed by bending at right angles to base leg 182. A column engagement flange 188 is also formed, at right angles, to base leg 182. As with clip 140 shown in FIGS. 8–10, clip 180 may be attached either to column C by banding (FIG. 13) or by attachment of the clip to either the ceiling or decking by using an appropriate fasteners 190 shown in FIG. 12. As described with respect to clip 140, the upper clips 180 are attached either to the column or ceiling and a corner angle 192 is engaged around upstanding legs 184 and 186. Clips 180 are then inserted in the lower end of angles 192 and positioned relative to column C as required to plumb the corner angles. These clips are then fastened to the decking or floor by using an appropriate fastener 190. Gypsum board G is then attached to corner angles 192 using a suitable fastener 194.

Figure 14:
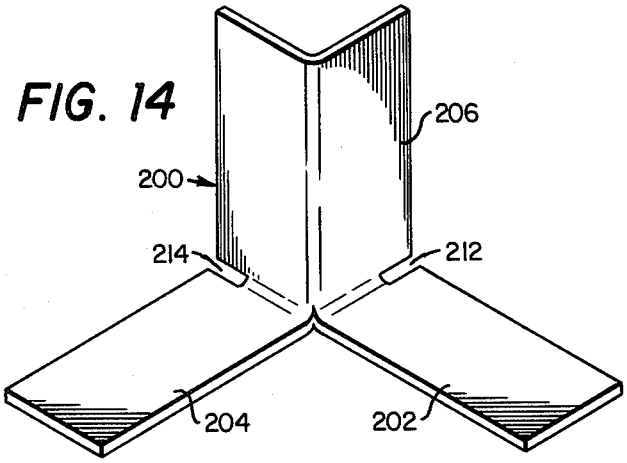
FIG. 14 is a perspective view of another corner clip used in an alternative embodiment of the present invention.
Figure 15:
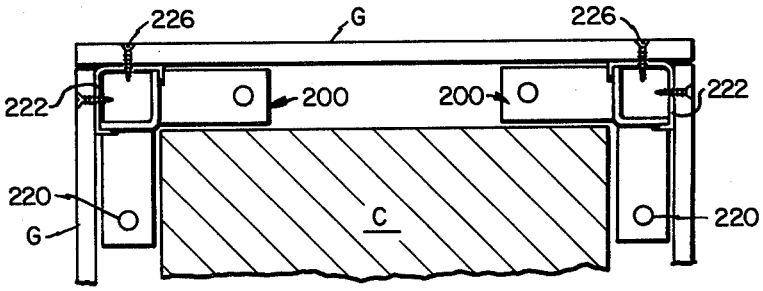
FIG. 15 is a section view as it would appear taken on a column in which the clip shown in FIG. 14 is used to attach furring around the column.
Figure 16:
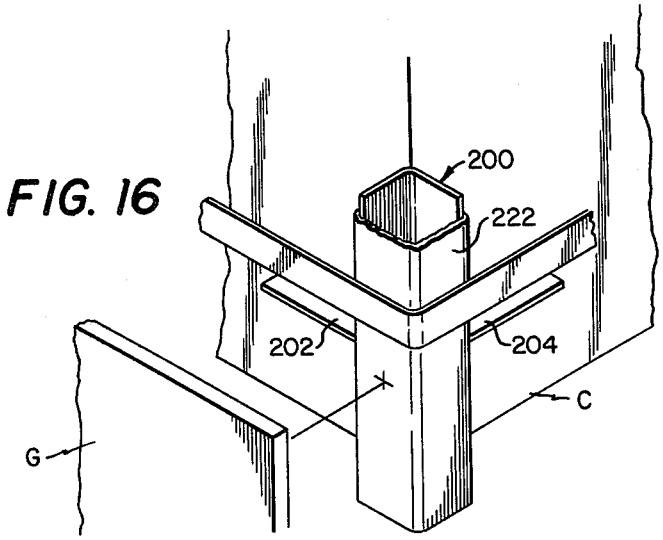
FIG. 16 is a perspective view showing the alternative embodiment of FIG. 14 used in attaching furring to a column.

Referring to FIGS. 14–16, another alternative clip 200 is shown used to attach furring adjacent to a column. Clip 200 includes base legs 202 and 204 having an upstanding angle leg 206. Notches 212 and 214 are formed between upstanding angle leg 206 and base legs 202 and 204, respectively. As shown in FIG. 16, clip 200 may be used to attach furring around a column by attaching either or both base legs 202 and 204 to either to the floor or ceiling using appropriate explosive charge fasteners 220 or their equivalent. A corner angle 222 is then clipped around angle leg 206. A clip 200 is then inserted at the upper end of corner angle 222 and is moved into engagement with the ceiling above column C where it is attached using appropriate attachment fasteners driven through base legs 202 and 204. Although four fasteners are shown in FIG. 15 as attaching clip 200 to the floor, it will be understood that as few as one fastener may suffice to make this connection.

Prior to attaching the clip 220 to the ceiling, the fitting may be moved so that corner angle 220 is plumbed. In this way, gypsum board or other furring G attached to corner angle 220 by appropriate screw fasteners 226 will also be plumbed.

FIG. 16 illustrates yet another manner in which clip 200 may be used to attach furring adjacent a column. In this arrangement, clip 200 is moved along the length of corner angle 222 until it is positioned an appropriate distance from the end thereof. Likewise, a similar clip is positioned at the opposite end of corner angle 222. Notches 212 and 214 permit the movement of the clip away from the end of corner angle 222 by allowing the inturned end tips of the angle to pass therethrough. With clips 200 mounted within the corner angle, this assembly may be engaged against the corners of the column as shown in FIG. 16 and attached thereto by use of a band attached around the corner angle at or near the point of positioning of clip 200. Clip 200 acts to position the corner angle away from the column while providing rigidity and strength to the angle. With corner angles 222 positioned in this manner at each of the corners of the column, gypsum board or other furring may be attached to the angles using appropriate fasteners. It will be appreciated that the use of clip 200 eliminates the possibility of engagement of fasteners 226 through both corner angle 222 and the upstanding angle leg 206 of clip 200. Thus, attachment of the gypsum board to corner angle 222 is facilitated by this arrangement.

While the alternative clips shown in FIGS. 8–16 have all been described as used to attach furring around or adjacent to a column, it will be appreciated that these same clips can be used to attach a furring adjacent other types of structures, including wall structures, half columns and the like. In these applications, the clips may be attached either to the floor or ceiling structure or to the structure itself by fasteners or adhesives. Thus, the structures illustrated in FIGS. 8–16 permit plumbing of the furring attached adjacent a structure. It will be understood that the clips illustrated in FIGS. 1–7 may also be modified, such as by providing an out turned foot from legs 40 and 42 of clip 20 to permit attachment of the clips to the ceiling or decking structure rather than directly to the column. Thus, the clip embodied in FIGS. 1–7 may also be used to plumb the corner angles 60 thereby aligning the furring attached thereto with true vertical. The present invention is intended to encompass the use of the present invention for such attachments.

Figure 17:
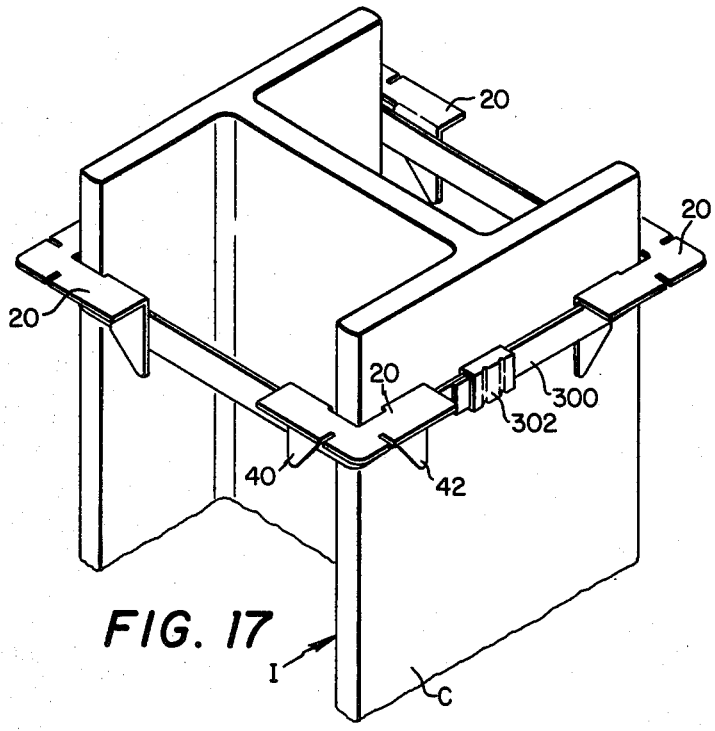
FIG. 17 is a perspective view showing the clip of FIG. 2 used in attaching furring to a steel column.
Figure 18:
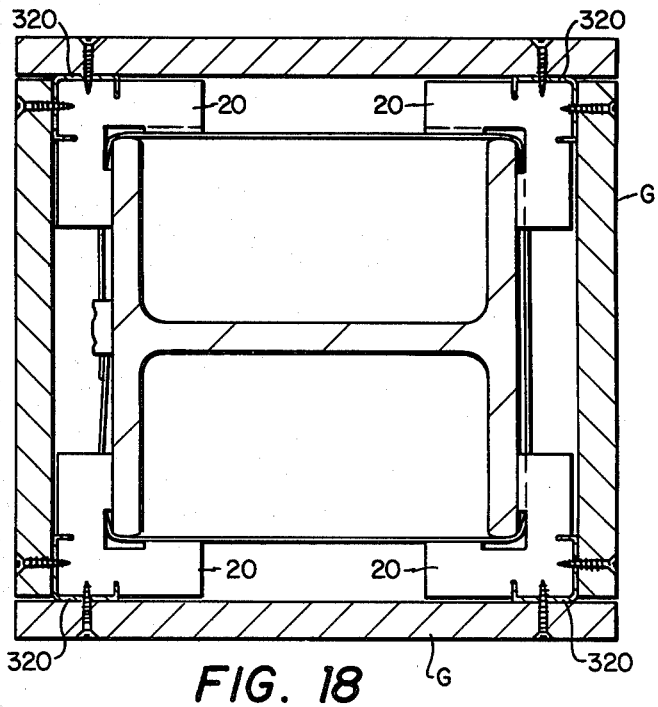
FIG. 18 is a section view as it would appear taken on FIG. 17 with furring attached adjacent each side of the column.

FIGS. 17 and 18 illustrate the use of clip 20, shown in the embodiment of FIGS. 1 through 6, in the attachment of furring to a steel I-beam column. As can be seen in FIGS. 17 and 18, clips 20 are attached at the corner of the I-beam using a band 300 encircling the column and joined at its ends by an appropriate crimp fitting 302. As is best seen in FIG. 18, the downwardly extending leg of clip 200 positioned adjacent the cap C of I-beam I is engaged between band 300 and cap C. Band 300 then passes to the inside of the other downwardly extending leg. In this way, as band 300 is pulled tight, clip 20 is prevented from turning in at the corner and is maintained square as is shown in the drawings.

In the same way as described with respect to FIGS. 1 through 6, a corner angle 320 is engaged within the notches in clip 20 and gypsum board G is attached to the corner angles 320 by appropriate fasteners.

Figure 19:
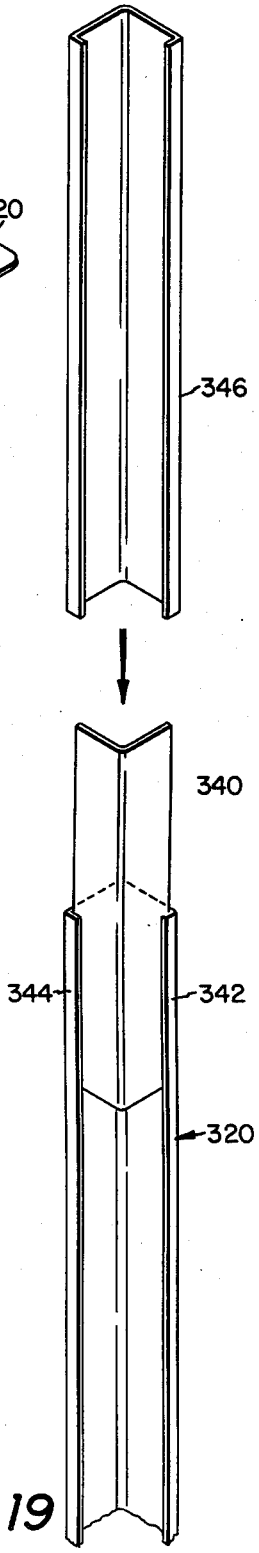
FIG. 19 illustrates a structure for splicing two pieces of corner angle used in the present invention.

In many cases, the corner angles 320 on a job site may be underlength for a particular application. FIG. 19 shows a method and structure for splicing two pieces of corner angle using a splice angle 340. Angle 340 is a right angle dimensioned to be received within the inturned end tips 342 and 344 of angle 320. Angle 340 is engaged into angle 320 to complete a box structure. The splice is completed by engaging a second piece of corner angle 346 over a portion of splice angle 340 extending from corner angle 320. This splice arrangement is both simple in its construction and provides a structurally sound splice.

Although preferred embodiments of the invention have been described in the foregoing Detailed Description and illustrted in the accompanying Drawings, it will be understood that the invention is not limited to the embodiments disclosed, but is capable of numerous rearrangements, modifications and substitutions of parts and elements without departing from the spirit of the invention. Accordingly, the present invention is intended to encompass such rearrangements, modifications and substitutions of parts and elements as fall within the spirit and scope of the invention.

We claim:

1. A system for attaching furring adjacent a walled structure extending from a decking comprising:

a clip having a base leg attached to the decking adjacent the structure and a corner angle leg extending from said base leg with a portion thereof for substantially longitudinal alignment with the structure;

means for attaching said clip adjacent the structure with the longitudinal axis of the corner angle leg substantially parallel to the longitudinal axis of the structure, said corner angle leg receiving one end of a corner angle thereon, the corner angle serving to receive fasteners therein for holding furring adjacent the structure.

2. The system according to claim 1 wherein said base leg comprises a member for attachment to the decking adjacent the structure and said corner angle leg extends at an angle from said base leg substantially longitudinally of the structure for receiving the corner angle thereon.

3. The system according to claim 1 wherein said base leg comprises a member for attachment to the structure and wherein the corner angle leg comprises a portion oriented substantially longitudinally of the structure for receiving the corner angle thereon.

4. The system according to claim 2 or claim 3 wherein said corner angle comprises an angle having inturned end tips for engagement around said corner angle leg and said corner angle leg is oriented at an appropriate angle to position the first leg of the corner angle parallel to one face of the structure.

5. The system according to claim 4 wherein said corner angle leg is oriented to position the second leg of the corner angle parallel to a second face of the structure.

6. The system according to claim 2 or claim 3 wherein said structure is a column; and said corner angle leg of said clip is positioned to receive a corner angle having two legs substantially parallel, respectively, to two adjacent sides of said column.

7. The system according to claim 6 wherein said corner angle leg is a flat member.

8. The system according to claim 2 or claim 3 wherein said structure is a column and said corner angle leg of said clip comprises a two member leg, one member being substantially parallel to one of two adjacent sides of the column and the other being substantially parallel to the other adjacent side to receive the corner angle thereon.

9. The system according claim 1 wherein a pair of said clips is attached adjacent the structure at spaced points along its length to receive the upper and lower ends of the corner angle.

10. A system for attaching furring adjacent a structure extending from a decking comprising:

a clip comprising a first portion having first and second base legs substantially perpendicular one to the other, said first base leg selectively attached to said structure and said second base leg for selective attachment to said decking, said clip further comprising a corner angle leg extending substantially perpendicularly from said second base leg;

means for attaching said clip adjacent the structure, said corner angle leg receiving one end of a corner angle thereon, the corner angle serving to receive fasteners therein for holding furring adjacent the structure.

11. The system according to claim 10 wherein said structure extends between a ceiling thereabove and a decking therebelow, and wherein said first base leg comprises a member for attachment to the ceiling or decking adjacent the structure and said corner angle leg extends at an angle from said first base leg substantially longitudinally of the structure for receiving the corner angle thereon.

12. The system according to claim 10 wherein said second base leg comprises a member for attachment to the structure and wherein the corner angle leg comprises a portion oriented substantially longitudinally of the structure for receiving the corner angle thereon.

13. The system according to claim 10 wherein said corner angle leg of said clip is a flat member.

14. The system according to claim 10 wherein a pair of said clips is attached adjacent the structure at spaced points along its length to receive the upper and lower ends of the corner angle.

* * * * *